United States Patent [19]

Jaulmes

[11] 4,331,013

[45] May 25, 1982

[54] ANTI-THEFT DEVICE

[75] Inventor: Christian Jaulmes, Pantin, France

[73] Assignee: Ateliers de la Motobecane, Pantin, France

[21] Appl. No.: 129,733

[22] Filed: Mar. 12, 1980

[30] Foreign Application Priority Data

Mar. 13, 1979 [FR] France ..... 79 06360

[51] Int. Cl.[3] ..... E05B 49/00

[52] U.S. Cl. ..... 70/278; 70/237; 70/276; 70/413; 335/206; 335/207

[58] Field of Search ..... 70/278, 276, 237, 413, 70/448, 449; 200/42 R, 43–45; 335/207, 206; 340/543

[56] References Cited

U.S. PATENT DOCUMENTS

| | | | |
|---|---|---|---|
| 2,566,017 | 8/1951 | Cooley | 200/87 |
| 3,606,776 | 9/1971 | Drach, Jr. | 70/276 |
| 4,019,171 | 4/1977 | Martelet | 335/207 X |

FOREIGN PATENT DOCUMENTS

| | | | |
|---|---|---|---|
| 1524601 | 3/1970 | Fed. Rep. of Germany . | |
| 2213533 | 8/1973 | Fed. Rep. of Germany | 70/278 |
| 2362546 | 6/1975 | Fed. Rep. of Germany | 70/278 |
| 2629346 | 1/1978 | Fed. Rep. of Germany | 70/413 |
| 2346529 | 12/1977 | France | 70/276 |
| 483108 | 1/1970 | Switzerland | 335/207 |

*Primary Examiner*—William E. Lyddane
*Attorney, Agent, or Firm*—Browdy and Neimark

[57] ABSTRACT

An anti-theft device for a vehicle having an internal combustion engine provided with an electrical circuit constituting an ignition or engine-heating circuit. The device includes a first circuit member having an output, a second circuit member having an input, the first and second circuit members being parts of the electrical circuit. A plurality of magnetic switches are disposed in a housing. One or more of the magnetic switches are electrically connected in series between the output of the first circuit member and the input of the second circuit member, all remaining ones of magnetic switches are connected between the input of said second circuit member or the output of the first circuit member and ground of the electrical circuit. One or more magnets are carried on a support in the form of a key which can be inserted into a slot in the housing. When the key is in place in the housing, the magnet or magnets are adjacent respective ones of the magnetic switches which are to be closed to effect connection between the two circuit members. At the same time, those portions of the key adjacent the other magnetic switches are free of magnets.

25 Claims, 12 Drawing Figures

ANTI-THEFT DEVICE

BACKGROUND OF THE INVENTION

The present invention relates to an anti-theft device and, more particularly to a safety lock apparatus adapted for establishing an electrical connection between a first member and a second member.

Safety locks are known which operate as anti-theft devices, particularly in motor vehicles the contact breaker of which is controlled by a key operable in a lock. If this type of safety lock is to be efficient, it has to be provided with a large number of combinations, and in this case, it has the disadvantage of being complex and consequently very expensive.

It is easily conceivable that it is not possible to provide a low cost motor vehicle, such as a light weight motorcycle or so called MOPED of small cylinder capacity with a complex, effective safety lock. Such vehicles are consequently generally provided with simple and often ineffective safety locks. As a result, such vehicles have heretofore been poorly and ineffectively protected.

SUMMARY OF THE INVENTION

The present invention aims at mitigating the above-noted disadvantages by providing a safety lock of a known type and of simple construction and, consequently, low cost but nevertheless of undeniable efficiency because, in spite of its simplicity, it provides a large number of combinations.

To this effect, the anti-theft device includes a lock of generally known type. The lock has a plurality of magnetic switches disposed in proximity to a housing for cooperating with magnets carried by a support adapted to be introduced inside the housing to act as a key, this lock being adapted to establish an electrical connection between an output of a first circuit member and an input of a second circuit member of an ignition circuit which control ignition or a heating circuit of an internal combustion engine. At least one of the switches is connected in series between the output of the first circuit member and the input of the second circuit member. The other switches are connected between a point of reference potential (ground) and either the output of the first circuit member or the input of the second circuit member.

According to one embodiment of the present invention, the magnetic switches are arranged in parallel one to the others in the vicinity of one of the housing walls provided for receiving the key and in a substantially straight line along the wall.

The magnetic switches may be of the symmetrical or the unsymmetrical type. The key provided for being engaged in the housing of the lock for controlling the closing of the magnetic switches mounted in series between the output of the first circuit member and the input of the second circuit member and the maintenance in an opened condition of the other switches, is composed of a support having the same cross-section as the above-mentioned housing on which are fixed the magnets in equal number to that of the magnetic switches which are to be closed. The magnets are further arranged on the support so that they are opposite only each of the switches which are to be opened.

It is easy to understand that such a lock is inexpensive because the magnetic switches, as well as the magnets which are incorporated into the key, can be produced at low cost.

The number of combinations which are possible with the key depends on the number of magnetic switches, in any given embodiment, it being understood that with a number n of switches each of which having two positions, $2^n$ combinations are available.

It is obviously possible to increase the number of combinations by providing the cross-section of the key and its housing with a particular profile such as notches along one or several of its side edges or again one or several longitudinal grooves on one or several of its side faces. Thus the key may be small, but carry a large number of magnets.

In the case where the magnetic switches are of the symmetrical type, the key magnets are aligned along the longitudinal axis of the latter.

In the case where the magnetic switches are of a unsymmetrical type, the magnets are arranged on the key along two parallel lines.

A further advantage of the anti-theft device resides in the fact that, in the case of its application to the constitution of an anti-theft device for an internal combustion engine vehicle, the magnetic switches may be brought together with the first and second circuit members the output and input of which are to be connected, the whole assembly being embedded in a moldable material block such as a block made of a curable plastic material. In such a case, it is impossible for a third person, who is not in possession of the key to form the electrical connection necessary to enable the operation of the engine because the two conductors to be connected are not traceable, as is the case with lock contacts of the prior art. This is a distinct additional advantage of the present invention.

BRIEF DESCRIPTION OF THE DRAWINGS

The invention becomes more apparent from the following description of some embodiments thereof, reference being made to the accompanying schematic drawings in which the invention is illustrated only by way of example.

DETAILED DESCRIPTION OF THE PREFERRED EMBODIMENTS

Figure 1:
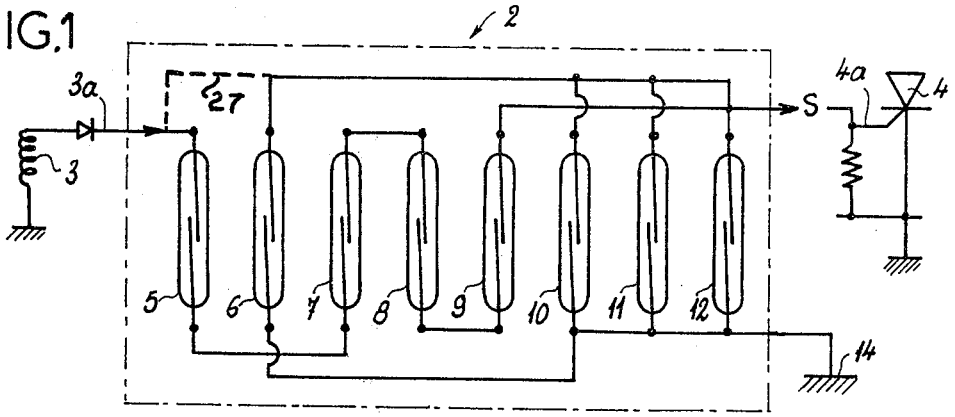
FIG. 1 is an electrical schematic diagram of a magnetic lock constituting a lock of an exemplary embodiment of an anti-theft device in accordance with the present invention, eight magnetic switches being provided.

In the example shown in FIG. 1, a lock 2 according to the invention is interposed between an output 3*a* of a coil 3 connected in series with a diode and the trigger electrode 4*a* of a thyristor 4 of an ignition circuit of an internal combustion engine, a spark gap S being connected to the trigger electrode.

As illustrated in FIG. 1 the lock 2 provides, when correctly operated, the electrical connection between the output 3*a* from the coil 3, via the diode and the aforementioned trigger electrode 4*a*, via the spark gap S.

Figure 3:
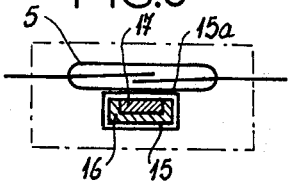
FIG. 3 is a partial sectional view of the lock of FIG. 1 in the vicinity of the housing of the key, in the case where symmetrical magnetic switches are used.

In this exemplary embodiment, the lock 2 includes eight magnetic switches 5 to 12 of the symmetrical type, meaning that their closing is controlled when a magnet is placed opposite overlapping portions of the pairs of contact blades of the respective switches 5–12, one such magnet 17 being shown adjacent to the magnetic switch 5 in FIG. 3.

Referring again to FIG. 1, it is noted that the magnetic switches 5, 7, 8 and 9 are mounted in series between the output 3*a* and the trigger electrode 4*a*; whereas, the switches 6, 10, 11 and 12 are mounted in parallel between the trigger electrode 4*a* and a point of reference potential illustrated as common ground 14.

In order that the electrical connection, via the diode, between the output 3*a* from the coil 3 and the trigger electrode 4*a* be effected, the magnetic switches 5, 7, 8 and 9, on the one hand, all have to be closed. If any of the magnetic switches 6, 10, 11 and 12 were closed, the trigger electrode 4*a* would be connected to ground 14.

For reaching this result, it is therefore necessary to place opposite each of the magnetic switches 5, 7, 8 and 9 respective magnets which respectively control the closing of these switches while simultaneously assuring that no magnet will have been placed opposite the other magnetic switches 6, 10, 11 and 12 to assure that these switches remain open. If any of the magnetic switches 6, 10, 11 or 12 were closed, the trigger electrode 4*a* would be connected to ground 14. Thus, even were all of the magnetic switches 5, 7, 8 and 9 activated, no trigger pulse would pass to electrode 4*a* and the internal combustion engine would not start.

As an alternative to connecting the magnetic switches 6, 10, 11 and 12 to ground 14 from trigger electrode 4*a* via the gap S, these magnetic switches may be connected to ground 14 from the output lead 3*a* from the coil 3 via the diode, as indicated by the dash line 27.

Figure 2:
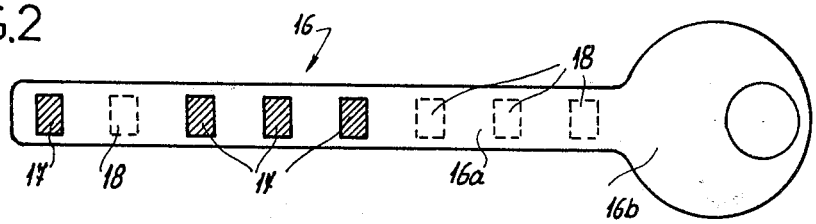
FIG. 2 is a plan-view of a key which permits the opening of the lock of FIG. 1, that is which effects an electrical connection between an output of a first circuit member and an input of a second member.

The magnetic switches 5 to 12 of the lock 2 are placed in the vicinity of one wall 15*a* of the walls of a housing 15 adapted for receiving a support 16 on which are four fixed magnets 17, as is shown in FIGS. 2 and 3. The support 16 is thus operatively constructed and arranged to act as a key for the lock 2; therefore, it is advantageously formed, as shown in FIG. 2, with a stem 16*a* and a handling head 16*b*. Along the stem 16*a* of the key 16, a plurality of the magnets 17 are fixed, each of which being arranged so as to control one of the magnetic switches 5, 7, 8 and 9 which have to be closed when the key 16 is introduced inside the housing 15 of the lock. The locations 18 on the stem 16*a* of the key 16 correspond to the switches 6, 10, 11 and 12 which have to be kept open, and are therefore not provided with magnets.

By modifying the electrical connections of the switches 5–12 and the mounting position of the switches, one can obtain various combinations, that is locks the opening of which can be controlled only by a specially determined type of the key 16, having its magnet places and no-magnet places corresponding to the given lock.

Since each magnetic switch has two possible positions, the number of possible combinations with eight magnetic switches is equal to $2^8$, that is 256.

Nevertheless, one has not to eliminate the solution in which all the magnetic switches have to remain open, since, in such a case, there would be no need of a key for providing the electrical connection. With eight magnetic switches, it is therefore possible to obtain 255 different combinations.

Figure 4:
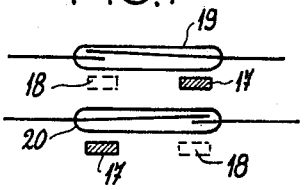
FIG. 4 is a schematic view illustrating the operation of the type of lock illustrated in FIG. 1 where unsymmetrical magnetic switches are used.
Figure 5:
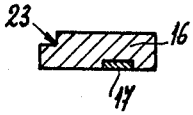
FIGS. 5 to 8 are respective sectional views of four distinct embodiments of keys which can be used in cooperation with the lock of FIG. 1.
Figure 6:
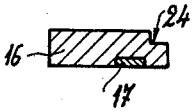
Figure 7:
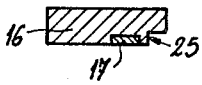
Figure 8:
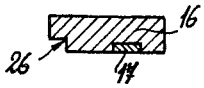

FIG. 4 shows an alternative lock consisting in using magnetic switches 19 and 20 of an unsymmetric type.

The operation of the unsymmetric switch is possible only if the magnet provided for actuating it is off-set on the opposite side of the overlapping area of the contact blades of the switch. The magnet 17 shown in FIG. 4, for controlling a switch 19, must therefore be off-set to the right and the magnet 17 provided for controlling a switch 20 will have to be off-set to the left.

Figure 9:
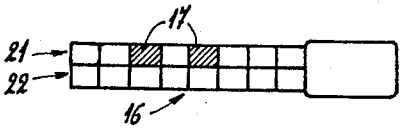
FIGS. 9 and 10 are similar views to that of FIG. 2, at a reduced scale, showing two embodiments of respective keys which can be used in the case where the lock has unsymmetrical magnetic switches.
Figure 10:
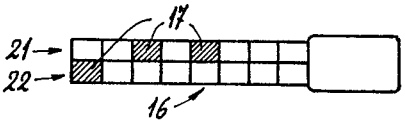

The operation of a lock provided with unsymmetric switches as the switches 19 and 20 necessitates therefore the use of a key where the magnets 17 are in alignment along two parallel rows 21 and 22, and is shown in FIGS. 9 and 10. This disposition allows therefore increasing still more the number of possible combinations with the same number of magnetic switches.

It should be noted that a key comprising, in addition to the useful magnets, magnets corresponding to the unsymmetric switches which are not to be closed, but are off-set relative to the unsymmetric switches on the side opposite to that corresponding to their closing, have with respect to the lock the same effect as if it included only those magnets necessary for the opening of the lock. For example, a key 16 shown in FIG. 10 can be used with success with a lock corresponding to the somewhat different key 16 of FIG. 9, in the case where the location of the magnet 17 in a row 22 corresponds to the inoperative side of a unsymmetric magnetic switch which is to remain open.

Figure 11:
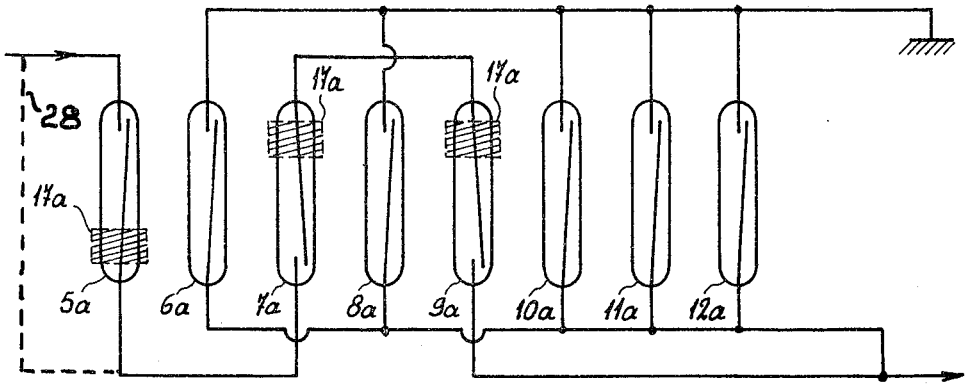
FIG. 11 shows similar lock to that of FIG. 1, provided with unsymmetrical magnetic switches.
Figure 12:
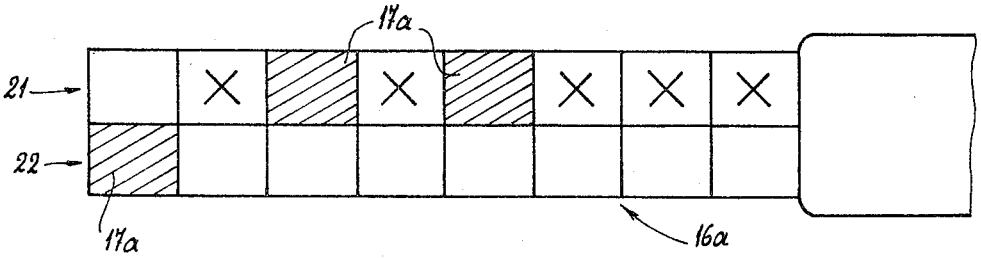
FIG. 12 is a partial view of a key of the type useful for opening the lock of FIG. 1, although not specifically adapted to that lock.

FIGS. 11 and 12 show respectively a lock and a key. The lock, the electric diagram of which is identical to that of lock of FIG. 1, includes eight unsymmetric magnetic switches 5*a* to 12*a*, the switches 5*a*, 7*a* and 9*a* being the only ones which have to be closed. As shown, at the locations 17*a*, it is necessary to place the magnets for closing the switches 5*a*, 7*a* and 9*a* and consequently open the lock.

As an alternative to connecting the magnetic switches 6*a*, 10*a*, 11*a* and 12*a*, as shown in FIG. 11, between ground and the spark gap, these magnetic switches may be connected to ground from a point corresponding to the output 3*a* in FIG. 1, as indicated by the dashed line 28. FIG. 12 shows a key 16*a* allowing opening the lock of FIG. 11. It is easy to understand that if the lock 16*a* were provided with magnets at the locations marked with a cross (X), such magnets would be inoperative relative to the corresponding switches 6*a*, 8*a* and 10*a* to 12*a*. Consequently, despite the presence of the unnecessary magnets, the key 16*a* can open the lock of FIG. 11.

In the case where the number of combinations possible when using unsymmetrical switches is considered as insufficient, in the case where it is not possible to increase the number of switches, it is therefore, still possible to provide the stem 16*a* of the key 16 and its associated housing 15 of the lock with an unsymmetric cross-section such as, for example, through one or more notches 23, 24, 25 or 26 provided along one of its longitudinal edges, as is shown in FIGS. 5 to 8. Thus, one obtains for the same electrical disposition of the lock, such as is shown in FIG. 2, four times more combinations since some of the keys of FIGS. 5 to 8 can be used in the place of another.

It could be possible to further multiply the combinations by providing in addition to the notches 23 to 26, grooves or other appropriate deformations of the cross-section of the stem 16*a* of the key 16 and of its housing 15.

As previously indicated, the burgular-proof character of the lock may be further improved by associating the elements with all or part of elements of the ignition device inside a casing filled with a plastic material or any other moldable material such as a curable resin.

It stands to reason, from the hereabove description, that the invention is not limited in scope to the embodiments and variants described or to the explanations concerning the anti-theft device given hereabove; on the contrary, it includes all possible alternative embodiments, the scope being defined in the appended claims.

What is claimed is:

1. An anti-theft device for a vehicle having an internal combustion engine provided with an electrical circuit, the device comprising: a first circuit member having an output; a second circuit member having an input, said first and second circuit members being parts of said electrical circuit; a plurality of magnetic switches disposed in a housing, at least one of said magnetic switches being electrically connected in series between the output of said first circuit member and the input of said second circuit member, all remaining others of said plurality of magnetic switches being connected between the input of said second circuit member and a point of reference (ground) potential of said electrical circuit; a movable support adapted to be introduced into said housing; at least one magnet carried on said support and, each said magnet carried by said support being positioned when said support is operatively positioned in said housing in the vicinity of a respective corresponding one of said magnetic switches to close same effecting an electrical connection between the output of said first circuit member and the input of said second circuit member.

2. An anti-theft device according to claim 1, wherein said magnetic switches are electrically connected in parallel one to the others along at least one straight line.

3. An anti-theft device according to either claim 1 or claim 2, wherein said magnetic switches are of a symmetric type.

4. An anti-theft device according to either claim 1 or claim 2, wherein said magnetic switches are of an unsymmetric type.

5. An anti-theft device according to claim 1 or claim 2 wherein said support comprises a key adapted to be inserted into a slot formed in said housing for controlling the closing of said at least one of said magnetic switches and assuring an open position of others of said magnetic switches which are to be open, said magnets being further arranged on said support so that, when said key is engaged in said slot in said housing, each comes respectively opposite a respective one of said magnetic switches.

6. An anti-theft device according to claim 5, wherein said magnets are aligned on said key.

7. An anti-theft device according to claim 5, wherein said magnets are arranged on said key along two parallel lines.

8. An anti-theft device according to claim 5, wherein the cross-section of said key and at least an inlet portion of said slot in said housing has a particular profile which is unsymmetric.

9. An anti-theft device according to claim 8, wherein said unsymmetric profile of said cross-section of said key results from notches provided along at least one of the longitudinal edges of said key, said inlet portion at least of said slot in said housing of said key formed with a protrusion corresponding to each of said notches.

10. An anti-theft device according to claim 9, wherein said particular profile of said cross-section of said key results from the presence of at least one longitudinal groove extending along the length of at least one of the side faces of said key, and wherein said inlet portion of said slot of said housing is formed with protrusions corresponding to each of said grooves.

11. An anti-theft device according to claim 8, wherein said particular profile of said cross-section of said key results from the presence of at least one longitudinal groove extending along the length of at least one of the side faces of said key, and wherein at least said inlet portion of said slot of said housing is formed with protrusions corresponding to each of said grooves.

12. An anti-theft device according to claim 1 or claim 2, wherein said housing comprises a casing inside which a moldable material such as a curable resin has been placed and in which said first and said second circuit members and said magnetic switches are embedded.

13. An anti-theft device for a vehicle having an internal combustion engine provided with an electrical circuit, the device comprising: a first circuit member having an output; a second circuit member having an input, said first and second circuit members being parts of said electrical circuit; a plurality of magnetic switches disposed in a housing, at least one of said magnetic switches being electrically connected in series between the output of said first circuit member and the input of said second circuit member, all remaining others of said plurality of magnetic switches being connected between the output of said first circuit members and a point of reference (ground) potential of said electrical circuit; a movable support adapted to be introduced into said housing; at least one magnet carried on said support, each said magnet carried by said support being positioned when said support is operatively positioned in said housing in the vicinity of a respective corresponding one of said magnetic switches to close same effecting an electrical connection between the output of said first circuit member and the input of said second circuit member.

14. An anti-theft device according to claim 13, wherein said magnetic switches are electrically connected in parallel one to the others along at least one straight line.

15. An anti-theft device according to either claim 13 or claim 14, wherein said magnetic switches are of a symmetric type.

16. An anti-theft device according to either claim 13 or claim 14, wherein said magnetic switches are of an unsymmetric type.

17. An anti-theft device according to claim 13 or claim 14, wherein a support to be inserted into said housing for controlling the closing of said at least one of said magnetic switches and assuring an open position for others of said magnetic switches which are to be open, is formed as a key having a mating cross-section as a key slot formed in said housing and on which are fixed said magnets, said magnets being further arranged on said support so that, when said key is engaged in said slot in said housing, each comes respectively opposite a respective one of said magnetic switches.

18. An anti-theft device according to claim 17, wherein said magnets are aligned on said key.

19. An anti-theft device according to claim 17, wherein said magnets are arranged on said key along two parallel lines.

20. An anti-theft device according to claim 17, wherein the cross-section of said key and at least an inlet portion of said slot in said housing has a particular profile which is unsymmetric.

21. An anti-theft device according to claim 20, wherein said particular profile of said cross-section of said key results from the presence of at least one longitudinal groove extending along at least one of the longitudinal edges of said key, said inlet portion at least of said slot in said housing of said key formed with a respective protrusion corresponding to each of said notches.

22. An anti-theft device according to claim 21, wherein said particular profile of said cross-section of said key results from the presence of at least one longitudinal groove extending along the length of at least one of the side faces of said key, and wherein said inlet portion of said slot of said housing is formed with protrusions corresponding to each of said grooves.

23. An anti-theft device according to claim 20, wherein said particular profile of said cross-section of said key results from the presence of at least one longitudinal groove extending along the length of at least one of the side faces of said key, and wherein at least said inlet portion of said slot of said housing is formed with protrusions corresponding to each of said grooves.

24. An anti-theft device according to claim 13 or claim 14, wherein said housing comprises a casing inside which a moldable material such as a curable resin has been placed and in which said first and second circuit members and said magnetic switches are embedded.

25. An anti-theft device for a vehicle electrical circuit comprising a magnetic lock, said lock comprising a plurality of magnetic switches arranged in predetermined positions, at least one of said switches being electrically connected in series in said vehicle electrical circuit to control said circuit, all remaining others of said switches being electrically connected in a parallel circuit with each other between a reference potential and some other portion of said vehicle electrical circuit, a key carrying a number of magnets equal to said at least one switch which controls said circuit, and said number of magnets being arranged on said key to correspond to the position(s) of said at least one switch in said lock.

* * * * *